United States Patent [19]

Alspaugh et al.

[11] 4,241,352

[45] Dec. 23, 1980

[54] FEED NETWORK SCANNING ANTENNA EMPLOYING ROTATING DIRECTIONAL COUPLER

[75] Inventors: Mark H. Alspaugh, Boulder; Lawrence R. Murphy, Longmont, both of Colo.

[73] Assignee: Ball Brothers Research Corporation, Boulder, Colo.

[21] Appl. No.: 723,643

[22] Filed: Sep. 15, 1976

[51] Int. Cl.[2] ..... H01Q 3/26; H01P 5/18

[52] U.S. Cl. ..... 343/700 MS; 343/854; 333/116; 333/261

[58] Field of Search ..... 343/778, 854, 876, 100 SA; 333/31 R, 84 M, 98 TN, 116, 261

[56] References Cited

U.S. PATENT DOCUMENTS

| | | | |
|---|---|---|---|
| 1,950,708 | 3/1934 | Von Arco | 343/854 |
| 2,831,169 | 4/1958 | Casal | 343/854 |
| 2,961,620 | 11/1960 | Sommers | 333/84 M |
| 3,803,623 | 4/1974 | Charlot | 343/700 MS |
| 4,028,710 | 6/1977 | Evans | 343/854 |

*Primary Examiner*—Eli Lieberman

*Attorney, Agent, or Firm*—Cushman, Darby & Cushman

[57] ABSTRACT

A method and system for beam steering of a spatially fixed microwave antenna array. The phase of radiating elements and hence the beam position is established by the relative positions of a microwave disc or scan network having concentric microstrip paths thereon and a mechanically driven rotating directional coupler. The directional coupler is the single point feed for the antenna array.

8 Claims, 17 Drawing Figures

Fig. 6
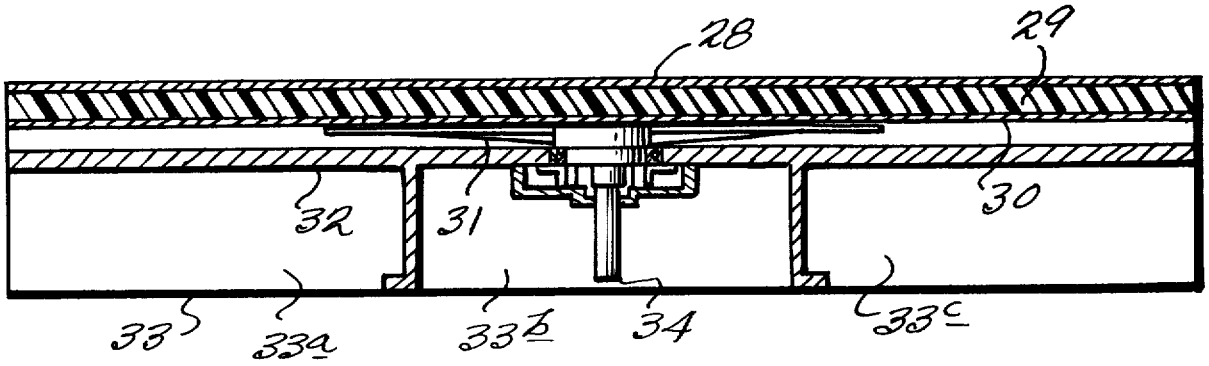
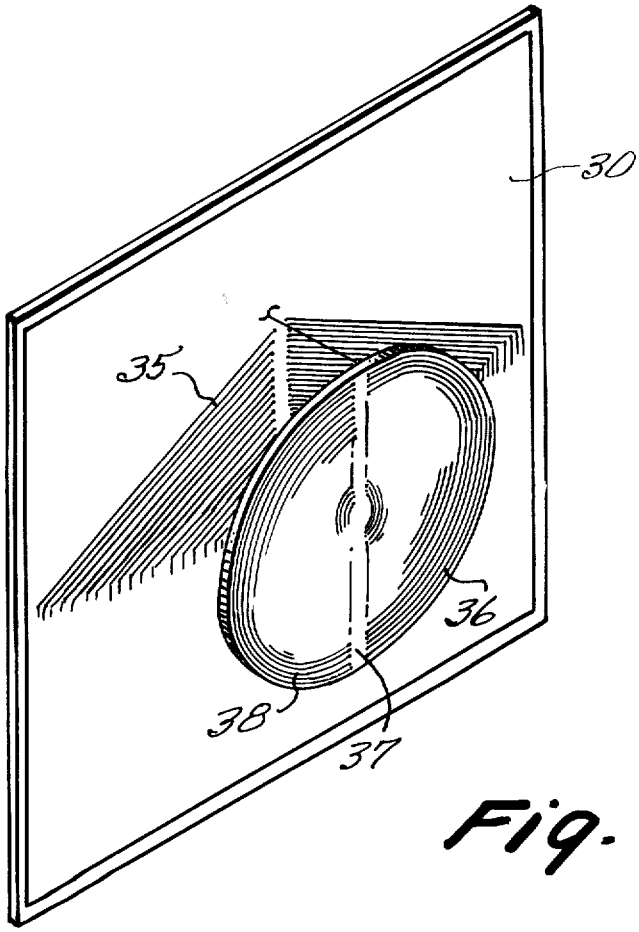
Fig. 7

Fig. 8
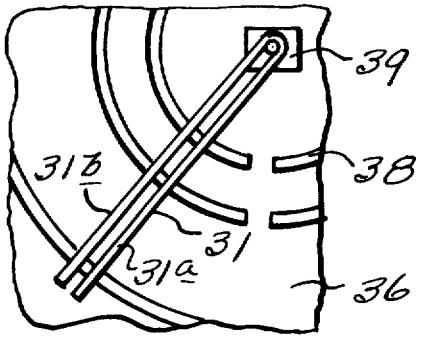
Fig. 9
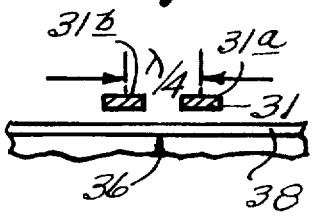
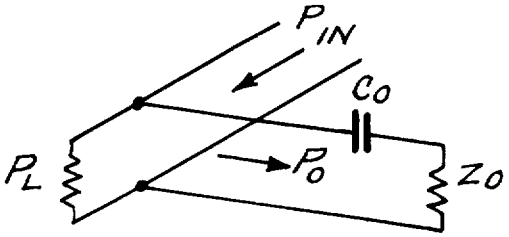
Fig. 10
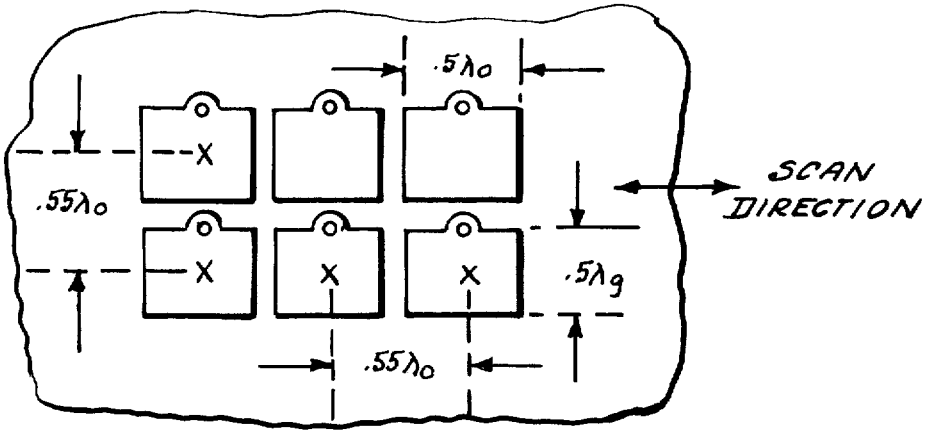
Fig. 13

FEED NETWORK SCANNING ANTENNA EMPLOYING ROTATING DIRECTIONAL COUPLER

BACKGROUND OF THE INVENTION

This invention pertains to a method and apparatus for beam steering a spatially fixed microwave antenna array.

The two primary means of beam steering microwave antennas in the prior art have been mechanical scanning on the one hand and electrical scanning on the other hand. Both types of beam steering have been used, for example, in connection with weather satellites. As a particular example, a system known as Scanning Microwave Spectrometer (SCAMS) was used aboard the Nimbus 6 satellite. The SCAMS system is a multi-channel instrument and achieves scanning or beam steering by stepping a reflector in front of each antenna. Each reflector rotates through 360° in 16 seconds. The rotation rates are low and because the beam widths are large (7.5°), contiguity of successive scan lines is attained. However, ground resolutions are not much better than about 145 km. at nadir.

Mechanical beam steering of higher resolution antennas is often difficult or incompatible with a particular application for several reasons. First, the spatial resolution of a microwave radiometer is directly proportional to the area of the antenna aperture. Higher spatial resolution infers a larger antenna with a narrower beam, thus a smaller footprint or resolution cell; and the available observation time for contiguous coverage is usually determined by other factors, especially for spaceborne applications. Thus, to gain contiguous coverage of a scene, large high resolution antennas must be scanned at high rates. The mechanical moments and torques involved and their impact on other system constraints often make mechanically scanned antennas impractical.

As another example of a prior art beam steering arrangement, the Nimbus 6 satellite also includes a system known as Electrically Scanning Microwave Radiometer (ESMR). The ESMR system achieves beam steering by electronically scanning the antenna. The antenna consists of a slotted waveguide array fed by an associated array of ferrite phase-shifters which are in turn controlled by a beam steering computer. Ferrite phase-shifters are devices in which the permeability properties are modified by application of a magnetic field. By varying the dc current through a coil surrounding the ferrite cores, which are series elements in the waveguide distribution, the phase of the feed network is shifted to achieve beam steering.

Unfortunately, the large array of ferrite devices is quite heavy and the total power required to drive the system is large. Beam broadening occurs not only because of the reduced aperture effect but also because the ferrite shifting approach is frequency sensitive. Thus the received energy of the lower end of the bandwidth arrives from a different direction than the energy at the upper end of the band. To minimize this effect, the bandwidth must be constrained, which in turn constrains system sensitivity.

OBJECTS AND SUMMARY OF THE INVENTION

What is needed is a means to achieve beam steering of a microwave antenna that does not have the torque, momentum and volume disadvantages of the mechanically scanned antenna and/or the weight, power and performance disadvantages of the electronically scanned antenna. It is an object of this invention to provide a system and method for beam steering a microwave antenna that does not have these disadvantages.

Briefly, in accordance with one embodiment of the invention, the beam scanning microwave antenna system and method includes an antenna array comprising a plurality of antenna elements. A single point system signal feed network is provided with a scan network coupling the single point system signal feed network to the antenna array. The scan network comprises a plurality of coupling paths extending between the single point system signal feed network and the respective antenna elements. The coupling paths, in accordance with one particular embodiment, are formed at least in part by conducting elements disposed in concentric circular segments. A rotating directional coupler is provided which couples the single point system feed network to the concentric circular conducting elements for varying the lengths of the respective coupling paths in accordance with the rotation of the directional coupler. Such varying of the length of the paths varies the phase relationship between the antenna elements in a scanning fashion across the plurality of antenna elements.

Further objects, advantages and details of the system and method of the present invention will appear from the detailed description which follows taken in conjunction with the accompanying drawings.

BRIEF DESCRIPTION OF THE DRAWINGS

FIG. 6 is a side view in cross section of a system having the elements shown in FIG. 5 assembled into a housing.

FIG. 7 is a perspective view illustrating details of the microstrip scan network.

FIG. 8 is a top plan view of a portion of the scan network and illustrating the rotational directional coupler.

FIG. 9 is an end view of a portion of the scan network and rotating directional coupler.

FIG. 10 is an equivalent circuit diagram for the directional coupler of this invention.

FIG. 13 is a top plan view of a portion of a suitable antenna array.

DETAILED DESCRIPTION

Figure 1:
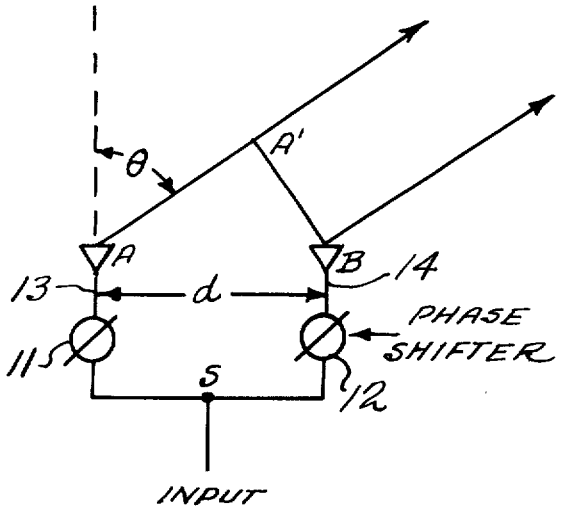
FIG. 1 is a diagrammatic illustration of the basic concept of beam steering from a spatially fixed antenna.

Turning now to the drawings, FIG. 1 shows the basic concept of beam steering from a spatially fixed antenna. For explanatory purposes throughout the description of this invention, the antenna system and method described herein will be treated as a transmitting antenna, with the principles of reciprocity being applicable. In general, the receiving properties of linear antenna systems may be deduced from their transmitting properties by the reciprocity theorem. Simply stated, the transfer impedance of the antenna is unchanged when the position of the generator and load are interchanged. See, for example, Electromagnetic Waves and Radiating Systems, Prentiss Hall, 1962 New Jersey, and particularly section 10.09 thereof.

Referring again to FIG. 1, assume that it is wished to transmit in the spatial direction defined by the angle $\theta$. To do so, energy emanating from antenna element A must arrive at A' in phase with the energy then emanating from antenna element B. If the antenna elements were in phase, then the phase difference in the plane defined by A' and B (normal to the paper), is given by $$\phi=(2\pi/\lambda o d \sin\theta \quad (1)$$

where $\lambda o$ = wavelength of radiated energy. This angle $\theta$ is the phase-shift required to be introduced into the antenna system in order to cause the beam to be radiated in the direction defined by the angle $\theta$. The phase-shifters 11 and 12 then must introduce the differential phase-shift $\phi$ into the feed lines 13 and 14 for the antenna elements A and B. The same principle can be expanded with additional phase-shifting elements to as many radiating elements as are needed to fill the aperture of the antenna.

As previously pointed out, one way of obtaining the needed phasing of a multi-element antenna array is through the use of ferrite phase-shifters. This technique has been utilized in the prior art and there are many prior art references describing such. Such a technique is, however subject to a large number of disadvantages for certain applications, as previously discussed herein.

Figure 2:
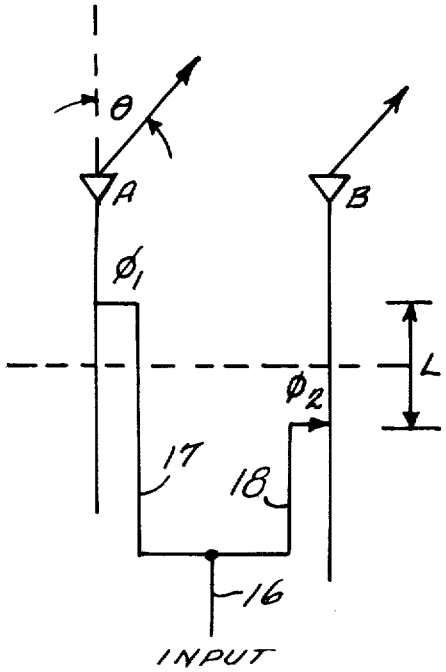
FIG. 2 is a diagrammatic illustration similar to FIG. 1 illustrating the manner in which a desired phase-shift can be achieved by directly introducing a time delay into the feed network of the antenna.

An alternative way of achieving the desired phase-shift, is to directly introduce a time delay into the feed network of the antenna. This approach is illustrated in FIG. 2. In FIG. 2 there are shown two antenna elements A and B, with the angle $\theta$ indicating the direction in which the beam is to be radiated. An input 16 is split into two feed lines 17 and 18 with the phase of the split feed lines being referred to as $\theta_1$ and $\theta_2$, respectively. The phase difference of the energy fed to the two antenna elements A snd B in FIG. 2 is a function of the differential length of the feed lines 17 and 18, denoted in FIG. 2 by L. Thus, the phase of the signal delivered by the feed lines to the antenna elements is given by $$\phi=(2\pi/\lambda g)\, L \quad (2)$$

the quantity $\lambda g$ is given by the following equation $$\lambda g = \lambda o\left[\epsilon_r - \left(\frac{\lambda o}{\lambda c}\right)^2\right]^{-\frac{1}{2}} \quad (3)$$

where $\epsilon_r$ is the relative dielectric constant of the feed lines and $\lambda c$ is the cutoff wavelength of the feed lines. If a wave-guide were used as the transmission medium or feed lines, $\lambda c$ is a function of the physical dimensions of the waveguide. Hence, the quantity $\lambda g$ as defined in equation (3) above would not be independent of frequency. In accordance with this invention as will hereinafter be described in detail, microstrip transmission line is utilized for the transmission medium or feed lines. For microstrip transmission lines the cutoff wavelength $\lambda c$ is essentially dc so that the quantity $\lambda c$ approaches infinity. Therefore, we can write the following equation $$\lambda g = \lambda o \epsilon_r^{-\frac{1}{2}} \quad (4)$$

Equating the equations 1 and 2 and substituting in the relationship of equation (4) yields the following $$\sin\theta = \left[\frac{\lambda o\, \epsilon_r^{\frac{1}{2}}}{\lambda o}\right]\left[\frac{L}{D}\right] = \epsilon_r^{\frac{1}{2}}\frac{L}{D} \quad (5)$$

from which it can be seen that the phase-shift $\phi$ is not a function of wavelength. Thus, an array constructed in accordance with the principles of equation (5) would be non-frequency dispersive. Further, inspection of equation (5) shows that a linear scan in phase yields a uniform scan in Sin $\phi$. This type of scan is optimum for footprint contiguous coverage without overlapping edges within a single scan.

Figure 3:
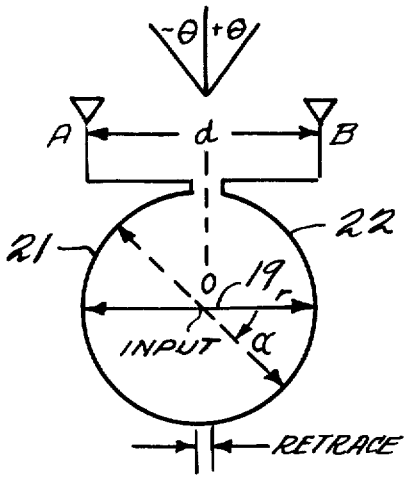
FIG. 3 is a diagrammatic illustration showing the fundamental basis of the feed network scanner system and method of this invention.

As equation (5) shows, a linear scan in phase can be achieved by a linear change in the length of the feed network or transmission paths to the antenna elements. While several different arrangements to achieve this linear scanning are possible, it has been found that feed paths arranged in concentric circular relationship with a rotating coupler is one of the best and most easily implemented arrangements. The basic principle for such an arrangement is illustrated diagrammatically in FIG. 3. In FIG. 3, a rotating coupler 19 rotates about the point O (which is a single point system signal feed) and couples the input signal through feed paths 21 and 22 to the antenna elements A and B respectively. The feed paths 21 and 22 are arranged in facing approximate semicircles, with there being a break or interruption associated with a retrace interval.

The two antenna elements A and B illustrated in FIG. 3 are separated by a distance d and the scanning angles $+\theta$ and $-\theta$ have been diagrammatically indicated in FIG. 3. The rotating coupler 19 has a radius of r and rotates, with the angle $\alpha$ indicating the amount of its rotation from a reference position. As can be seen from an inspection of FIG. 3, the length of microstrip transmission lines 21 and 22 feeding the two antenna elements is a function of the instantaneous position of the rotating coupler 19. It can be seen that as the rotating coupler 19 rotates through the angle $\alpha$, the length of feed line 21 feeding antenna element A has been reduced by $r\alpha$, and the length of feed line 22 for antenna element B has been increased by $r\alpha$. The net change or difference in feed length is $2r\alpha = L$. Thus from equation (5) it can be seen that $$\theta = \mathrm{Sin}^{-1}\left[\frac{2\epsilon_r^{\frac{1}{2}}\, r\alpha}{d}\right] \tag{6}$$

it can also be seen from FIG. 3 that, by symmetry, a rotation of the coupler 19 through an angle of $\pi$ produces one scan line. For example, with the rotating coupler 19 at an almost vertical position the feed line length 21 associated with antenna element A is maximized and the feed line length 22 associated with antenna element B is minimized. The beam is thus steered to the maximum angle associated with $-\theta$. After a rotation of slightly less than $\pi$, the inverse is true and the beam is steered to $+\theta$. Retrace time as indicated on FIG. 3 is associated with the deleted sections of the feed lines on the circular configuration.

The parameters of such a system are determined by the angle $\theta$ through which it is desired to scan or steer the beam. Assume, for purposes of an example, that the angle $\theta$ over which it is desired to steer the beam is $\pm 42°$. If the reference orientation of the rotating coupler is such that when it is horizontally positioned in FIG. 3, where $\alpha=0$ and $\theta=0$, then a rotation of a bit less than 90° of the coupler 19 is associated with a scan of 42°. If it is also assumed that the retrace segment is on the order of $0.1\pi$, then $$\mathrm{Sin}\ 42° = 0.669 = \frac{2\epsilon_r^{\frac{1}{2}}\, r\,(\pi/2 - .05\pi)}{d} \tag{7}$$

and $$r \simeq [2.37 \times 10^{-1}]\,\frac{d}{\epsilon_r^{\frac{1}{2}}} \tag{8}$$

For microstrip transmission line with air dielectric, which is assumed hereafter in the detailed analysis of the preferred embodiment of the invention, $\epsilon_r = 1$ so that $$r \simeq (2.37 \times 10^{-1})\ d \tag{9}$$

Figure 4:
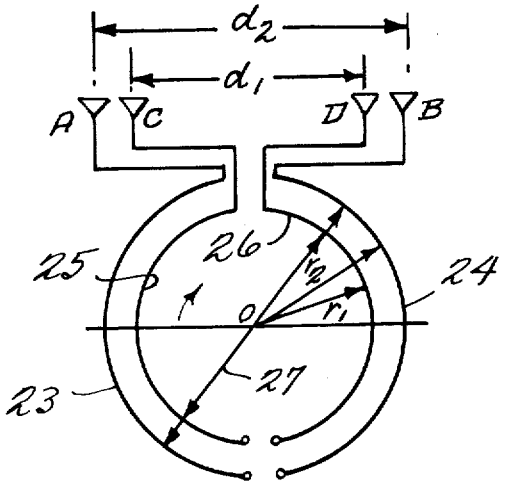
FIG. 4 is a diagrammatic illustration of the expansion of the concept of the present invention to a number of antenna elements.

Turning now to FIG. 4, there is shown a pictorial representation of an expansion of the scanning concept of this invention to a multiple element array. In FIG. 4, four antenna elements A, B, C, and D are illustrated. Four corresponding feed paths 23, 24, 25 and 26 are provided for the respective antenna elements. The input feed signal to point O is coupled by a rotating coupler 27 to the circular segment feed paths. As before, the feed paths to correspondingly located antenna elements on opposite sides of the center line of the antenna array are disposed as corresponding halves of a concentric circle. Thus, for the antenna elements A and B in FIG. 4, the feed paths 23 and 24 are arranged as corresponding facing halves of a circle having a radius $r_2$, and the feed paths 25 and 26 for the antenna elements C and D are arranged as corresponding facing halves of a circle having a radius $r_1$ and being concentric to the circle having the radius $r_2$. In general, for any number of antenna elements in the antenna array, the radius for the concentric circular dispositions of the microstrip feed lines for feeding the various elements in the array (if a scan angle of $\pm 42°$ is used) is given by $$r_i = (2.37 \times 10^{-1})\ d_i \tag{10}$$

While it is believed that FIG. 4 and the detailed description presented above in connection therewith provides a sufficiently detailed description of the invention to enable those skilled in this art to practice the invention, nevertheless there follows hereafter a description of the hardware and physical elements which can be employed in constructing a particular embodiment of the invention.

Although in keeping with the invention an antenna element array can be provided which consists of any desired number of antenna elements, the particular embodiment of the invention described hereafter in detail comprises a 192 by 192 array of radiating elements. Although an orthogonally polarized dual channel capability could be provided, the following description relates to a single polarization implementation.

In the single polarization implementation of a $192 \times 192$ element array, there are 192 antenna elements in a subarray or column, with there being provided 192 subarrays or columns. In order for the difference in coupling path lengths to the individual antenna elements to be determined in a linear fashion by the rotating coupler and the circular microstrip feed lines, the total length of all the feed lines between the single point system signal feed and the antenna elements must be equal. To achieve this end, a reference network and a corporate feed network are used to connect the circular microstrip portions to the individual feed lines. The reference network comprises a series of varying length microstrip transmission lines which compensates for the varying length of the circular segments due to their different radii. Thus the reference network insures equal path lengths to each of the subarrays or columns of antenna elements. The corporate feed network provides equal path lengths from a central connection for each subarray or column at the reference network, to each of the 192 individual elements in a column or subarray.

Figure 5:
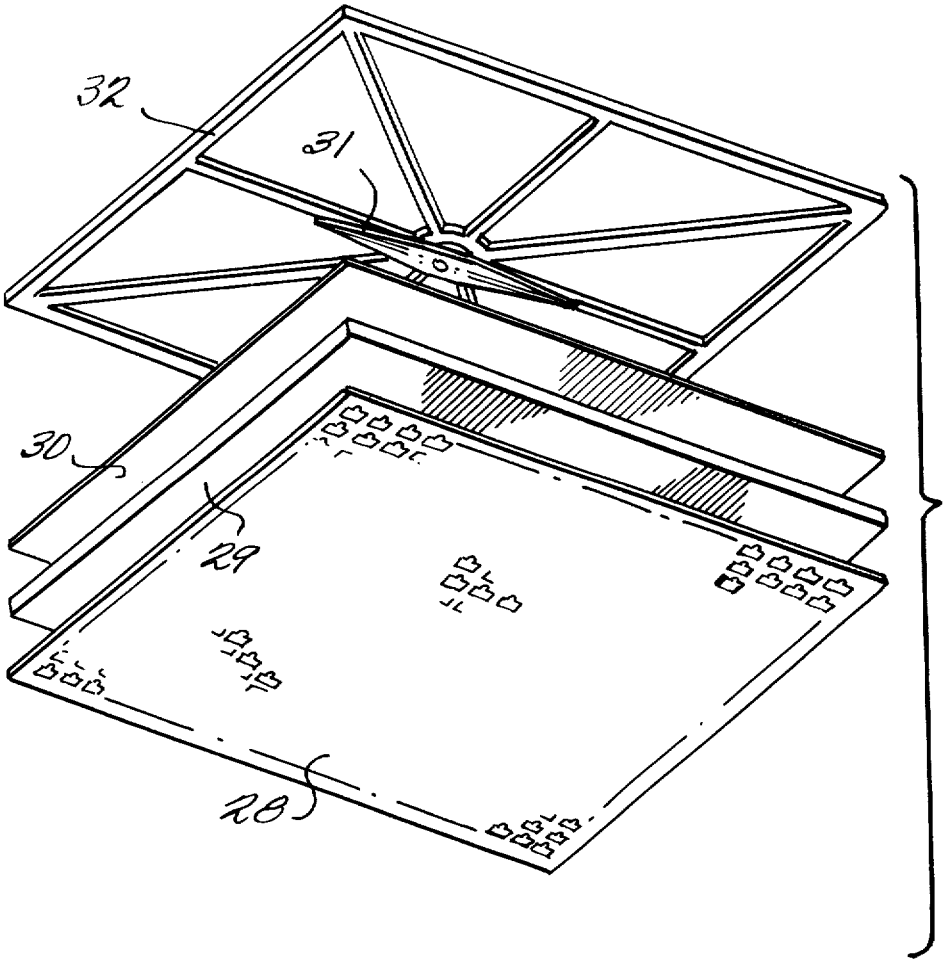
FIG. 5 is an exploded pictorial representation of an assembly of elements forming a beam scanning antenna system in accordance with the invention.

Referring now to FIG. 5, there is shown an exploded pictorial diagram of the major elements in a construction of a particular embodiment of the scanning antenna and method of this invention. An antenna array 28 is provided with there being an implementation of a corporate feed network 29 adjacent thereto for feeding (along equal path lengths) the individual elements of the antenna array. A microstrip scan network 30 (described in more detail hereafter and which includes a reference network) is provided on the opposite side immediately adjacent the corporate feed network. A rotating directional coupler 31 together with suitable mounting means 32 therefor is provided underlying the microstrip scan network.

FIG. 6 is a side view in cross section of the assembled elements of FIG. 5 forming the scanning antenna. As can be seen in FIG. 6, the various elements of FIG. 5 are assembled in a housing 33 which can include compartments such as 33*a*, 33*b*, and 33*c* for housing the electronic processing, receiver and/or transmitting components. Additionally, means such as a motor 34 are provided for rotating the directional coupler 31. A suitable motor would be one providing a constant rotational speed.

Turning now to FIG. 7, there is shown a perspective view illustrating details of the microstrip scan network 30. The microstrip scan network is an air dielectric (equivalent) strip line distribution network providing one coupling path or circuit for interconnection through corporate feed networks to each of the subarrays or columns. It functionally consists of two portions, a reference network generally indicated by reference numeral 35 and a scan network proper generally indicated by reference numeral 36. The reference network 35 can conveniently be constructed in a laminated fashion, in which there is provided a printed circuit board with feed lines photoetched on both sides, conjointly providing a single feed line conductor consisting of the two conductors electrically connected in parallel. The two outer portions of the laminate can consist of molded epoxy onto which a thin metallic film is deposited. The thin film then serves as the ground plane for the feed lines in the reference network. It has been found that such a construction causes minimum insertion loss and achieves an air equivalent relative dielectric constant, i.e. $\epsilon_r = 1$.

The purpose of the reference network 35 is to assure equal path feed line lengths to each of the 192 columns or sub-arrays. Since the path lengths of the concentric circular feed line segments differ in accordance with their different radii, the path lengths of associated feed line lengths on the reference network also differ, but in an inverse relationship to the radii of the circular feed line lengths with which they are associated. Thus for each of the 192 feed lines the sum of the circular feed line segment length and the reference network feed line segment length is equal to a constant—the total lengths are all the same.

The scan network proper 36, in accordance with a specific embodiment of the invention, comprises a printed circuit board 37 having 192 circular microstrip transmission line segments formed thereon, one for each of the 192 columns in the antenna array. The 192 circular segments 38 formed on one side of the printed circuit board 37 are arranged as corresponding facing halves (or approximate halves) of 96 concentric circles. The opposite side of the scan network proper 36 has metallization formed thereon which serves as a ground plane, with suitable overlying insulation and connecting pins therethrough for connecting the circular segments 38 to corresponding paths in the reference network 35.

Each of the circular segments 38 in the scan network 36 comprises a portion of a feed line and are each connected to an associated microstrip transmission path comprising a portion of the feed line which is formed on the reference network 35. The paths on the reference network 35 as mentioned before are configured such that the total path length (comprising the circular segment and corresponding path on the reference network) of all of the feed paths are equal. Therefore, the path on the scan network 36 which includes the outermost (and hence longest) concentric circular segment has the shortest path length on the reference network 35; the path on the scan network 36 which includes the innermost (and hence shortest) of the concentric circular segments has the longest path length on the reference network 35; and so on. Various configurations are possible for the reference network and will occur to those skilled in this art. FIG. 7 shows only a diagrammatic representation of the reference network.

Turning now to FIGS. 8 and 9, there is shown a portion of the scan network proper 36, illustrating the microstrip scan lines 38 and the rotational directional coupler 31. The rotating directional coupler 31 has two radial arms 31*a* and 31*b* forming an air dielectric microstrip directional coupler. A single point feed for the complete antenna array is coupled to the directional coupler through means such as a rotating RF joint identified by reference numeral 39. As illustrated in FIG. 9, the rotating directional coupler is co-planar with the microstrip elements 38 of the microstrip scan network proper 36, with coupling provided across the air gap between the rotating directional coupler and the microstrip scan network. The two radial arms 31*a* and 31*b* of the rotating directional coupler 31 are fed 90° out of phase and are separated by a distance of $\lambda/4(90°)$. Hence, feed in the direction of the antenna is in phase and additive, while coupling in the anti-antenna direction is out of phase and cancels.

In accordance with the particular embodiment of the invention being here discussed, a rotation of the rotating directional coupler through 180° gives one complete scan. If desired, signal feed to the directional coupler can be reversed in phase for every 180° rotation thereof so that two complete scans can be obtained through a single 360° rotation of the directional coupler. Alternatively one complete scan can be obtained through a 180° rotation with the remaining 180° rotation being "dead" time between scans.

Figure 6A:
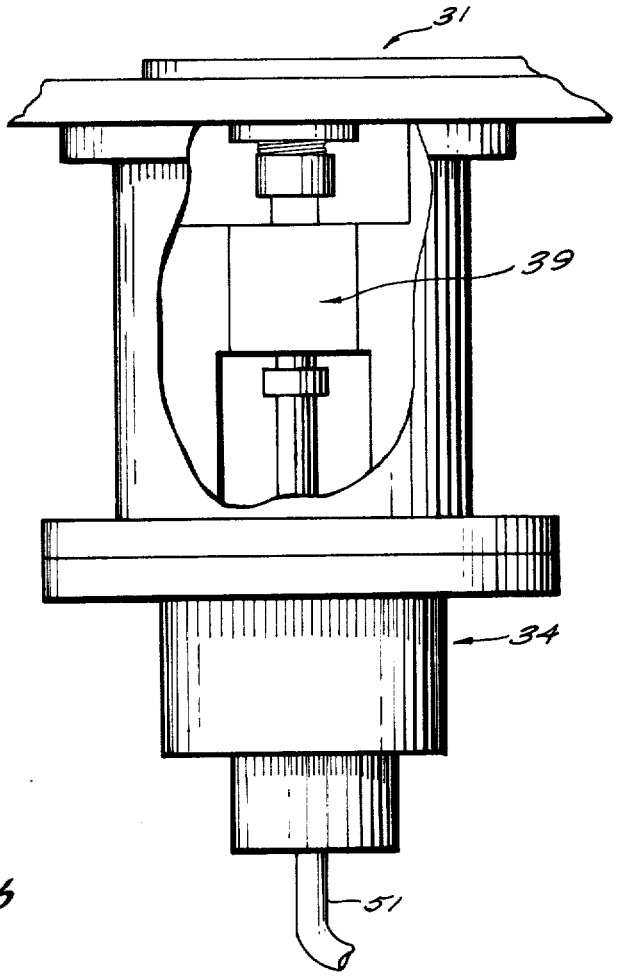
FIG. 6A is an enlarged illustration of one embodiment of a directional coupler and associated apparatus in accordance with the invention.

FIG. 6A is an enlarged illustration, partially broken away, showing the relationship between the rotating directional coupler 31, the rotary RF joint 39 and the motor 34, with means such as a feed cable 51 carrying the antenna input to the rotary RF joint 39.

Figure 6B:
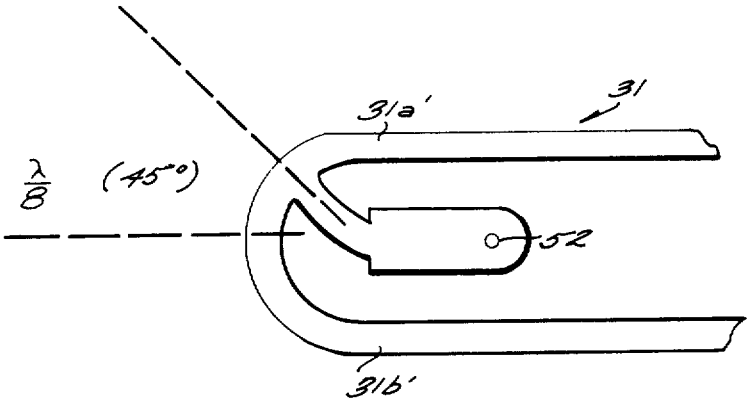
FIG. 6B is a top plan view of part of the directional coupler of FIG. 6A.

FIG. 6B is a top plan view of a suitable rotating directional coupler 31 for the situation where one complete scan is obtained through a 180° rotation with the remaining 180° rotation being "dead" time between scans. In FIG. 6B the feed point 52 of the microstrip line is coupled at a 45° or $\lambda/8$ rotation to the line 31*a*′ of the directional coupler 31. This rotation makes one of the lines 45° longer and one 45° shorter, so that the two lines or arms are thus fed 90° out of phase.

Figure 6C:
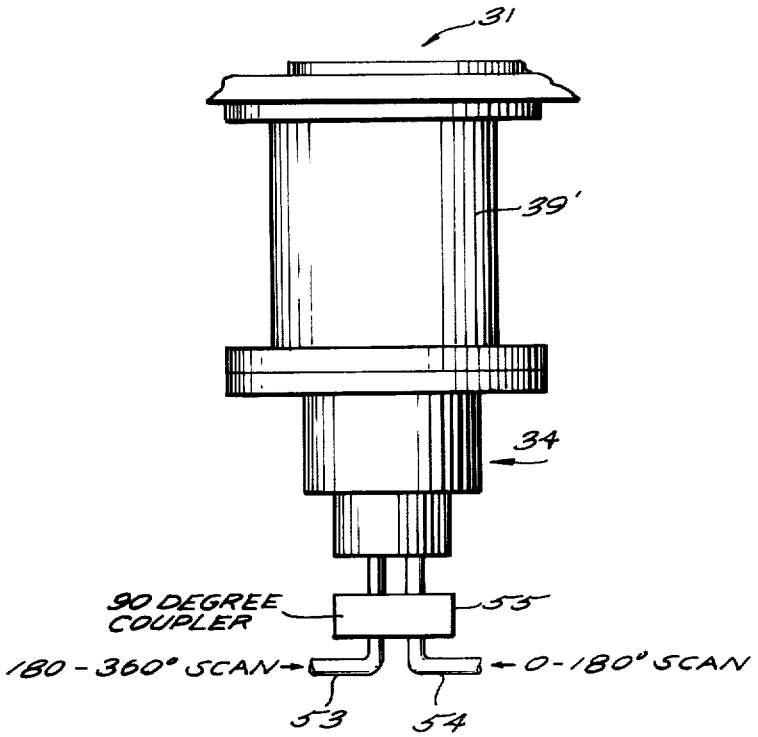
FIG. 6C is an enlarged illustration of another embodiment of a directional coupler and associated apparatus in accordance with the invention.

FIG. 6C is an illustration similar to FIG. 6A, but for the case in which signal feed to the directional coupler is reversed in phase for every 180° rotation so that two complete scans can be obtained through a single 360° rotation of the directional coupler. This embodiment requires two feed lines 53 and 54 with a 90° degree coupler 55 and a two channel rotary RF joint 39′.

Figure 6D:
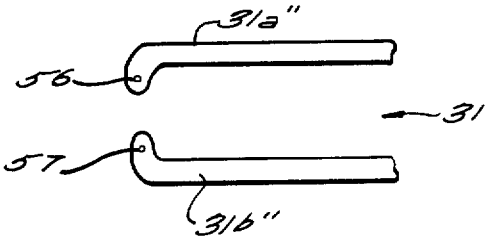
FIG. 6D is a top plan view of part of the directional coupler of FIG. 6C.

FIG. 6D is a top plan view illustrating the configuration of a directional coupler 31 for the embodiment of FIG. 6C. In this configuration, there are two feed points 56 and 57 feeding respectively the two arms 31*a*″ and 31*b*″.

In either of the embodiments discussed above the two feed lines of the rotating coupler line are phased 90 degrees apart and are spatially separated by $\lambda/4$. Each line is capacitively coupled to a circular feed line 38. This coupled energy is transmitted both to the right and left as shown in FIG. 9. If, in FIG. 9 it is desired that the energy be transmitted to the right, then line 31*a* would be phased −90° from that of line 31*b*(0°). The coupled energy from 31*b*(0°) which is transmitted to the right will be delayed by the $\lambda/4$ separation (−90°) and add with the coupled energy transmitted to the right from line 31*a* which was phased at −90°. The energy coupled from 31*a* (−90°) which is transmitted to the left will also be delayed by −90°, or be phased at 180°. This energy will cancel that transmitted to the left by 31*b*(0°). Thus, the coupler, by capacitive coupling of two feed lines spaced $\lambda/4$ and phased by 90° will couple energy in one direction to the radiating antenna elements.

The physical dimensions of the feed lines 38, their impedances and separation between the rotating directional coupler and the concentric feed line segments are parameters determined by the coupling required to obtain the objective aperture distribution, and can be calculated for particular applications by those skilled in the art. Each line of the rotating directional coupler may be considered a transmission line which is capacitively coupled to the array of concentric circular feed lines. The power distributed to each circular feed line segment is dependent upon the conductance that line presents to the rotating coupler line. Since in a tapered distribution the center elements require more power than the outer elements, the magnitude of the coupling required is greater for the center circular feed line segment than the outer ones. The coupling must be tailored to obtain the objective taper.

As an example, FIG. 10 is an equivalent circuit diagram illustrating how the coupler operates. For the purposes of this description, it is assumed that the Chebyscheff distribution is based upon a 35 db taper of the antenna beam, i.e. the first principle side lobes are 35 db below the main beam. For a discussion of the Dolph-Chebyscheff procedure, see R.C. Hansen, Microwave Scanning Antennas Volume II, New York, Academic Press, 1966.

For a 35 db Chebyscheff distribution $$Po = 0.02031\ Pin \tag{11}$$

and $$(Po/PL) = 0.02073 \tag{12}$$

and since the admittances $G_L$ and $G_1 = G_{in} = 0.02$ and $G_1 = G_L \times (Po/PL)$ then, $G_1 = 4.062 \times 10^{-4}$.

The quantity $G_1$ is the input admittance of Co and Zo. For this $G_1$, Co is approximately equal to 1.12 pf. As an example, for feed lines having dimensions of approximately 0.025 inches, the air gap or separation distance is approximately equal to 0.024 inches, or about $1/10 \times \lambda_0$ for an operating frequency of 37 GHz.

This separation distance is a minimum exemplary value since the 35 db Chebyscheff distribution was chosen as an example of a strong taper requiring maximum coupling near the center. Required coupling would decrease toward the outer edge of the standing network proper as is needed for side lobe suppression.

The variable parameters available to engineer the proper aperture distribution are the air gap separation and width of the conducting strips on the rotating directional coupler 31. Optimization routines lend themselves to quantitative analysis since the variable coupling capacity is readily calculated by those skilled in this art.

Figure 11:
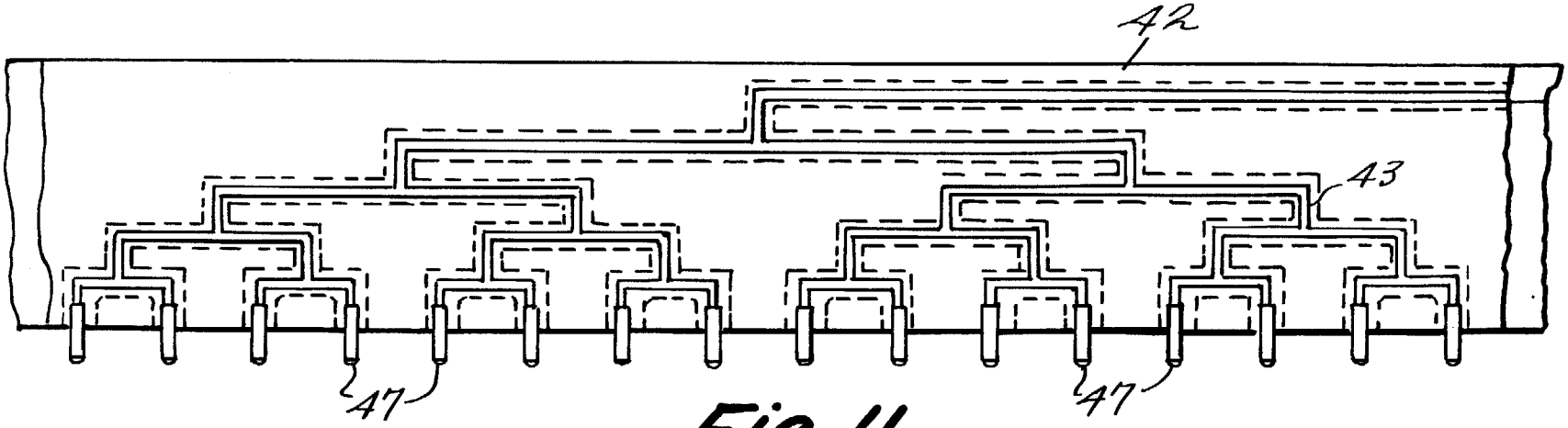
FIG. 11 is a top view of one module in the corporate feed network.
Figure 12:
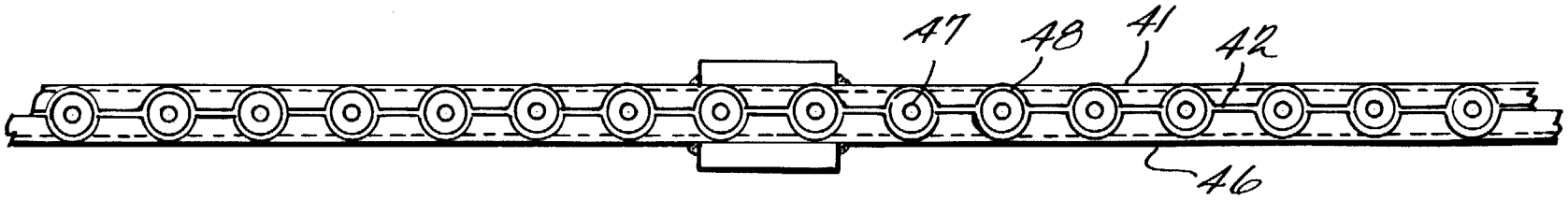
FIG. 12 is a side view of the module of FIG. 11.

Turning now to FIGS. 11 and 12, there is illustrated a typical arrangement for the corporate feed network. The corporate feed network provides a constant path length for the feed to each of (in this example) the 192 antenna elements in the $j^{th}$ column. Unlike end fed waveguide arrays, the corporate feed network provides a non frequency dispersive distribution to each of the columnar arrays. In order to minimize line losses in the corporate feed network, it is constructed as a laminated unit functionally comparable to subminiature coaxial line with an air dielectric.

Each corporate feed module 41 (a plurality of which are combined to form the corporate feed network 29) is a laminated unit comprising three laminate parts. A central laminate 42 can be constructed of a printed circuit board with feed lines 43 photoetched on both sides thereof to provide a single feed line conductor comprising two conductors connected in parallel. The two outer portions 44 and 46 of the laminate comprise molded epoxy onto which a thin metallic film is deposited. The thin film serves as the ground plane for the feed lines. The feed lines are terminated in pins 47 which are inserted through the substrate of the antenna array 28 (see FIG. 5) from the back and engage with the radiating elements. Channels 49 support and separate the laminates in the construction.

FIG. 13 is an illustration of a portion of the antenna array 28, showing some of the individual antenna elements 51. The array is conveniently constructed from a printed circuit board with all of the radiators 51 photoetched on one side. The opposite side of the board provides the ground plane and feedthroughs for interconnection to the corporate feed network.

There is indicated in FIG. 13 typical relative dimensional parameters for the size and spacing of the individual antenna elements. The antenna elements are essentially end fed dipoles, and in order to avoid secondary or grating lobes, the separation S between the elements is generally limited by the equation $$\frac{S}{\lambda o} < \frac{1}{1 + \sin\theta max} \tag{13}$$

It has been previously indicated that for purposes of discussing a specific example, it was assumed that a desired scan angle was ±42° and that a desired operating frequency was 37 GHz. The choice of frequency and scan angle for any particular application depends, of course, upon the particular parameters of the application for the scanning antenna system. For the particular example discussed herein, with a frequency of 37 GHz and scan angle of ±42°, the rate of rotation of the rotating directional coupler is on the order of 18.75 revolutions per minute. At the 37 GHz frequency, then $\lambda o = 0.81$ cm. and $\lambda g = 0.55$ cm. With the dimensional relationships as indicated in FIG. 13, then a 192×192 array yields a clear antenna aperture of approximately 34 square inches. Further, once the desired scan angle and dimensional relationships of the antenna array are chosen, then the radii of the concentric circular feed line segments are given by equations such as equations (7) and (8).

Thus what has been described is a method and system for scanning or beam steering a spatially fixed microwave antenna array which avoids the disadvantages of prior art systems and methods. The general considerations governing selection of parameters for a particular application of the invention have been discussed, and details of one particular embodiment of the invention have been described. It should be understood, however, that those skilled in this art may construct modifications and different embodiments of the invention without departing from the true spirit and scope of the invention.

We claim:

1. A microwave beam scanning antenna system having an antenna array comprising a plurality of antenna elements, a single point signal feed network, and a scan network coupling the single point signal feed network to said antenna array, said scan network comprising a plurality of coupling paths extending between said single point feed network and said antenna elements and including a planar portion and further including a cyclically mechanically displaced coupler spaced from but coplanar to said planar portion for electrically coupling said single point feed network to varying locations along said plurality of coupling paths, whereby the respective lengths of said plurality of coupling paths and hence phasing of the signals thereon vary in a cyclic fashion to achieve beam scanning of said antenna array.

2. A microwave beam scanning antenna system in accordance with claim 1 wherein said planar portion of said plurality of coupling paths are formed at least in part by conducting elements disposed in planar concentric circular segments, and wherein said cyclically mechanically displaced coupler comprises a rotating directional coupler coplanar to and cyclically rotating about the center of said concentric circular segments.

3. A microwave beam scanning antenna system having an antenna array comprising a plurality of antenna elements, a single point signal feed network, and a scan network coupling the single point signal feed network to said antenna array, said scan network comprising a plurality of coupling paths extending between said single point feed network and said antenna elements and including a planar portion formed at least in part by conducting elements disposed in planar concentric circular segments, and further including a cyclically mechanically displaced coupler comprising a rotating directional coupler spaced from and coplanar to and cyclically rotating about the center of said concentric circular segments for electrically coupling said single point feed network to varying locations along said plurality of coupling paths, whereby the respective lengths of said plurality of coupling paths and hence phasing of the signals thereon vary in a cyclic fashion to achieve beam scanning of said antenna array, and wherein said concentric circular segments are formed as a plurality of concentric sets of approximate semicircles, each set comprising two facing approximate semicircles having the same radius, the two approximate semicircles in each set being coupled to corresponding respective elements in said antenna array on opposite sides of the center line of said array, with semicircle sets of increased radius coupled to antenna elements of increased distance from the center line of said antenna array.

4. A microwave beam scanning antenna system in accordance with claim 1 wherein said plurality of coupling paths are formed of microstrip transmission lines.

5. A microwave beam scanning antenna system in accordance with claim 4 wherein said plurality of coupling paths are all the same physical length, with their electrical length and hence phase of the signals thereon being cyclically varied by said cyclically mechanically displaced coupler.

6. A microwave beam scanning antenna system in accordance with claim 5 wherein said cyclically mechanically displaced coupler is displaced in a linear fashion to achieve linear variation of phase in signals on said plurality of coupling paths.

7. A microwave beam scanning antenna system having an antenna array comprising a plurality of antenna elements, a single point signal feed network, and a scan network coupling the single point signal feed network to said antenna array, said scan network comprising a plurality of coupling paths formed of microstrip transmission lines extending between said single point feed network and said antenna elements and including a planar portion, and further including a cyclically mechanically displaced coupler spaced from but coplanar to said planar portion for electrically coupling said single point feed network to varying locations along said plurality of coupling paths, whereby the respective lengths of said plurality of coupling paths and hence phasing of the signals thereon vary in a cyclic fashion to achieve beam scanning of said antenna array, wherein said plurality of coupling paths are all the same physical length, with their electrical length and hence phase of the signals thereon being cyclically varied by said cyclically mechanically displaced coupler which is displaced in a linear fashion to achieve linear variation of phase in signals on said plurality of coupling paths, and wherein said cyclically mechanically displaced coupler comprises a rotating directional coupler having two radial arms spaced one-quarter wavelength apart and rotating at a constant predetermined speed.

8. A method of achieving beam scanning of a microwave antenna system of the type comprising a single point system signal feed and a plurality of spatially fixed antenna elements comprising the steps of coupling the single point system signal feed through a plurality of coupling paths to the spatially fixed antenna elements, and cyclically varying the lengths of the coupling paths so as to achieve a cyclic variation in the phase of electrical signals carried thereon, wherein the coupling paths have planar concentric circular segment portions, and in which the lengths of the coupling paths are varied by rotating about the center of the concentric circular segments a directional coupler to which the single point system signal feed is connected, whereby the coupling point along the circular segments varies to vary the effective length of the overall coupling paths of which the circular segments are a part.

* * * * *